US009010588B2

(12) United States Patent
Lambrecht

(10) Patent No.: US 9,010,588 B2
(45) Date of Patent: Apr. 21, 2015

(54) METHOD AND APPARATUS FOR ENGAGING A BEVERAGE EXTRACTION DEVICE WITH A CONTAINER

(71) Applicant: Coravin, LLC, Burlington, MA (US)

(72) Inventor: Gregory Lambrecht, Natick, MA (US)

(73) Assignee: Coravin, Inc., Burlington, MA (US)

( * ) Notice: Subject to any disclaimer, the term of this patent is extended or adjusted under 35 U.S.C. 154(b) by 25 days.

(21) Appl. No.: 13/793,370

(22) Filed: Mar. 11, 2013

(65) Prior Publication Data

US 2013/0292423 A1 Nov. 7, 2013

Related U.S. Application Data

(60) Provisional application No. 61/641,874, filed on May 2, 2012.

(51) Int. Cl.
*B65D 83/00* (2006.01)
*B67D 1/04* (2006.01)

(52) U.S. Cl.
CPC ..... *B67D 1/0412* (2013.01)

(58) Field of Classification Search
USPC ..... 222/399, 396, 400.7, 394, 152, 81–83; 141/4, 11, 14, 17, 67, 70, 319–320, 141/329–330
See application file for complete search history.

(56) References Cited

U.S. PATENT DOCUMENTS

| | | | |
|---|---|---|---|
| 718,163 | A | 1/1903 | Sherrard |
| 1,509,916 | A | 9/1924 | Waite |
| 2,367,077 | A | 1/1945 | Ward |
| 2,496,258 | A | 2/1950 | Alexander |
| 2,705,578 | A | 4/1955 | Burns |
| 3,191,533 | A | 6/1965 | Vandenberg |
| 3,200,094 | A | 8/1965 | Levinson et al. |
| 3,272,404 | A | 9/1966 | Graves et al. |
| 3,327,899 | A | 6/1967 | Reynolds et al. |
| 3,883,043 | A | 5/1975 | Lane |
| 3,976,221 | A | 8/1976 | Martin et al. |
| 4,011,971 | A | 3/1977 | Haydon |
| 4,143,678 | A | 3/1979 | Sugimura et al. |

(Continued)

FOREIGN PATENT DOCUMENTS

GB 2053867 A 2/1981

OTHER PUBLICATIONS

Invitation to Pay Additional Fees, Mailed Jul. 31, 2013 in connection with PCT/US2013/039227.

(Continued)

*Primary Examiner* — Frederick C Nicolas
(74) *Attorney, Agent, or Firm* — Wolf, Greenfield & Sacks, P.C.

(57) ABSTRACT

Devices and methods for clamping a beverage extraction device to a beverage container, such as a wine bottle. One or more clamp arms may be arranged to clamp the extraction device to a wine bottle as well as allow the device to be supported upright on a table top. Clamp arms may include tab and ridge features that operate to properly engage and position a wide variety of different bottle neck shapes relative to the device. The one or more clamp arms may move the bottle neck distally, e.g., toward a resilient pad, so that the neck is suitably positioned relative to the device. Proper positioning and engagement of the neck may allow for desired piercing of a cork or other closure of the bottle by the device.

42 Claims, 14 Drawing Sheets

(56) References Cited

U.S. PATENT DOCUMENTS

| | | | |
|---|---|---|---|
| 4,473,174 | A | 9/1984 | Heuser |
| 4,475,576 | A | 10/1984 | Simon |
| 4,595,121 | A | 6/1986 | Schultz |
| 4,674,662 | A | 6/1987 | Bergstrom et al. |
| 4,691,482 | A | 9/1987 | Heinemann et al. |
| 4,694,850 | A | 9/1987 | Fumino |
| 4,706,847 | A | 11/1987 | Sankey et al. |
| 4,856,680 | A | 8/1989 | Sitton |
| 4,867,209 | A | 9/1989 | Santoiemmo |
| 4,932,561 | A | 6/1990 | Boxall |
| 4,976,984 | A | 12/1990 | Yasukawa et al. |
| 4,982,879 | A | 1/1991 | Corrado et al. |
| 4,984,711 | A | 1/1991 | Ellis |
| 5,020,395 | A | 6/1991 | Mackey |
| 5,031,799 | A | 7/1991 | Owen |
| 5,139,179 | A | 8/1992 | Cecil |
| 5,163,909 | A | 11/1992 | Stewart |
| 5,180,081 | A | 1/1993 | McCann |
| 5,395,012 | A | 3/1995 | Grill et al. |
| 5,407,096 | A | 4/1995 | Smith |
| 5,413,230 | A | 5/1995 | Folter et al. |
| 5,413,247 | A | 5/1995 | Glasa |
| 5,590,696 | A | 1/1997 | Phillips et al. |
| 5,947,172 | A | 9/1999 | Glotin |
| 6,371,173 | B1 | 4/2002 | Liebmann, Jr. |
| 6,607,100 | B2 | 8/2003 | Phelps et al. |
| 6,789,698 | B2 | 9/2004 | Gloor et al. |
| 6,843,388 | B1 | 1/2005 | Hollars |
| 7,056,179 | B2 | 6/2006 | Courtney |
| 7,712,637 | B2 | 5/2010 | Lambrecht |
| 8,033,431 | B2 | 10/2011 | Sommerfield et al. |
| 8,141,746 | B2 * | 3/2012 | Lambrecht ..... 222/152 |
| 8,225,959 | B2 | 7/2012 | Lambrecht |
| 8,640,919 | B2 * | 2/2014 | Lambrecht ..... 222/82 |
| 8,746,502 | B2 * | 6/2014 | Lambrecht ..... 222/1 |
| 2011/0016692 | A1 | 1/2011 | Hollars |
| 2011/0056998 | A1 | 3/2011 | Lambrecht |

OTHER PUBLICATIONS

International Preliminary Report on Patentability, dated Nov. 4, 2014, in PCT/US2013/039227.

* cited by examiner

METHOD AND APPARATUS FOR ENGAGING A BEVERAGE EXTRACTION DEVICE WITH A CONTAINER

This application claims the benefit of U.S. Provisional application No. 61/641,874, filed May 2, 2012, which is hereby incorporated by reference in its entirety.

BACKGROUND OF INVENTION

This invention relates generally to the dispensing or other extraction of fluids from within a container, e.g., in the dispensing of wine from a wine bottle.

SUMMARY OF INVENTION

One or more embodiments in accordance with aspects of the invention allow a user to withdraw or otherwise extract a beverage, such as wine, from within a container that is sealed by a cork, plug, elastomeric septum or other closure without removing the closure. In some cases, removal of liquid from such a container may be performed one or more times, yet the closure may remain in place during and after each beverage extraction to maintain a seal for the container. Thus, the beverage may be dispensed from the bottle multiple times and stored for extended periods between each extraction with little or no effect on beverage quality. In some embodiments, little or no gas, such as air, which is reactive with the beverage may be introduced into the container either during or after extraction of beverage from within the container. Thus, in some embodiments, a user may withdraw wine from a wine bottle without removal of, or damage to, the cork, and without allowing air or other potentially damaging gases or liquids entry into the bottle.

In one aspect of the invention, a beverage extraction device includes a base for supporting components of the beverage extraction device, and at least one clamp arm mounted to the base and movable to clamp a beverage container neck and support the base on the beverage container. For example, a pair of clamp arms may be mounted to the base and be made movable relative to each other, such as by having one of the clamp arms pivotally mounted to the base, to engage with the beverage container neck. The clamp arms may engage the neck with force sufficient to support the device on the container neck, e.g., so that the device may be suspended or hang from the neck otherwise unsupported. A body may be movably mounted to the base, and a needle, having at least one lumen extending from a proximal end to a distal end, may be mounted to the body and be arranged to be inserted through a closure at an opening of a beverage container with movement of the body relative to the base. For example, if the one or more clamp arms engages the base such that the container neck is immobile relative to the base, the body and needle may be moved relative to the base to insert the needle through the cork or other closure of the container. In an embodiment having a pair of clamp arms, the body may be slideably movable relative to the base to move the distal end of the needle in a space between the clamp arms.

In one embodiment, the one or more clamp arms may be arranged to support the device in an upright orientation on a flat, horizontal surface such that the needle depends from the body with the distal end below the proximal end. For example, a pair of clamp arms may have a downwardly extending portion that are capable of contacting a table or countertop surface so that the device can be "stood" on the surface. In some arrangements, the body includes a lowermost portion, such as a bottom of a gas cylinder cover, that cooperates with the at least one clamp arm to support the device in the upright orientation on a flat, horizontal surface such that the needle depends from the body with the distal end below the proximal end.

In another aspect of the invention, a beverage extraction device includes a base for supporting components of the beverage extraction device, and a pair of clamp arms mounted to the base and having distal portions movable relative to each other to clamp a beverage container neck and support the base on the beverage container. Each distal portion of the clamp arms may have an inner surface with a distal tab and a proximal ridge arranged to contact the neck of a beverage container positioned between the distal portions of the clamp arms. For example, the distal tabs may contact the neck and urge the neck into a proper position relative to the clamp arms and the base. The proximal ridges may present a surface that helps engage the clamp arms with the neck, e.g., so that the ridges contact a lip of the container to prevent the neck from being withdrawn from the space between the clamp arms. A body may be movably mounted to the base, and a needle, having at least one lumen extending from a proximal end to a distal end, may be mounted to the body and arranged to be inserted through a closure at an opening of a beverage container with movement of the body relative to the base.

In one embodiment, the distal portions of the clamp arms are spring biased to move toward each other such that the tab and ridge of each clamp arm contacts a beverage container neck and urges the neck to move proximally relative to the clamp arms. This movement may cause the neck to engage with a resilient pad between the clamp arms and suitably position the cork or other closure for penetration by the needle.

In another aspect of the invention, a beverage extraction device includes a base for supporting components of the beverage extraction device and at least one clamp arm movably mounted to the base and having a distal portion arranged to clamp a beverage container neck and support the base on the beverage container. The at least one clamp arm may be arranged to urge the beverage container neck proximally and into contact with a pad on the base when the at least one clamp arm clamps the neck. Such contact may properly position the neck with respect to a needle of the device that is arranged to be inserted through a closure at an opening of a beverage container with movement relative to the base. For example, the at least one clamp arm and pad may position the neck so that the needle penetrates the cork or other closure at a desired position, e.g., away from a center of the cork that minimizes the chance of the needle penetrating the cork in a place that has been previously penetrated.

In another aspect of the invention, a beverage extraction device includes a base for supporting components of the beverage extraction device, and at least one clamp arm mounted to the base and movable to clamp a beverage container neck. The at least one clamp arm may be spring biased to move and clamp the container neck with a spring force sufficient to suspend the device on the beverage container, e.g., so that the container may be lifted and manipulated by lifting only the extraction device. This may allow a user to pour beverage from the container by handling the device only, and/or help ensure reliable insertion of a needle of the device into a cork or other closure of the container.

In another aspect of the invention, a beverage extraction device includes a base for supporting components of the beverage extraction device, and at least one clamp arm mounted to the base and movable to clamp a beverage container neck. The clamp arm may have a distal portion arranged to engage the container neck and be spring biased to move away from a clamping position, e.g., away from a neck positioned adjacent the base. A locking mechanism may be arranged to engage the clamp arm in a clamping position such that the clamp arm engages the container neck with a force sufficient to suspend the device on the beverage container. For example, a user may move the clamp arm against the spring bias to bring the clamp arm into a clamping position in contact with a neck, and the locking mechanism may lock the clamp in engagement with the neck. The locking mechanism, which may include a buckle, ratchet/pawl mechanism, etc., may keep the clamp arm in a clamping position until the locking mechanism is released by a user.

Various embodiments may include a gas source fluidly coupled to the needle of the extraction device which is arranged to deliver pressurized gas to the at least one lumen at the proximal end of the needle. This may allow the device to introduce pressure into the container which is used to allow extraction of beverage from the container. For example, the gas source may include a compressed gas cylinder, pressure regulator, valve, etc. Thus, the needle of the device may be arranged for insertion through a cork of a wine bottle for delivery of a gas into a wine bottle and/or for delivery of wine from the bottle. The needle may be arranged to be used with closures that include a material capable of resealing upon withdrawal of the needle from the closure. For example, typical wine bottle corks may allow a needle to be passed through the cork to extract wine from the bottle, and then reseal upon removal of the needle such that gas and/or liquid are prevented from passing through the cork after needle removal.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Figure 1:
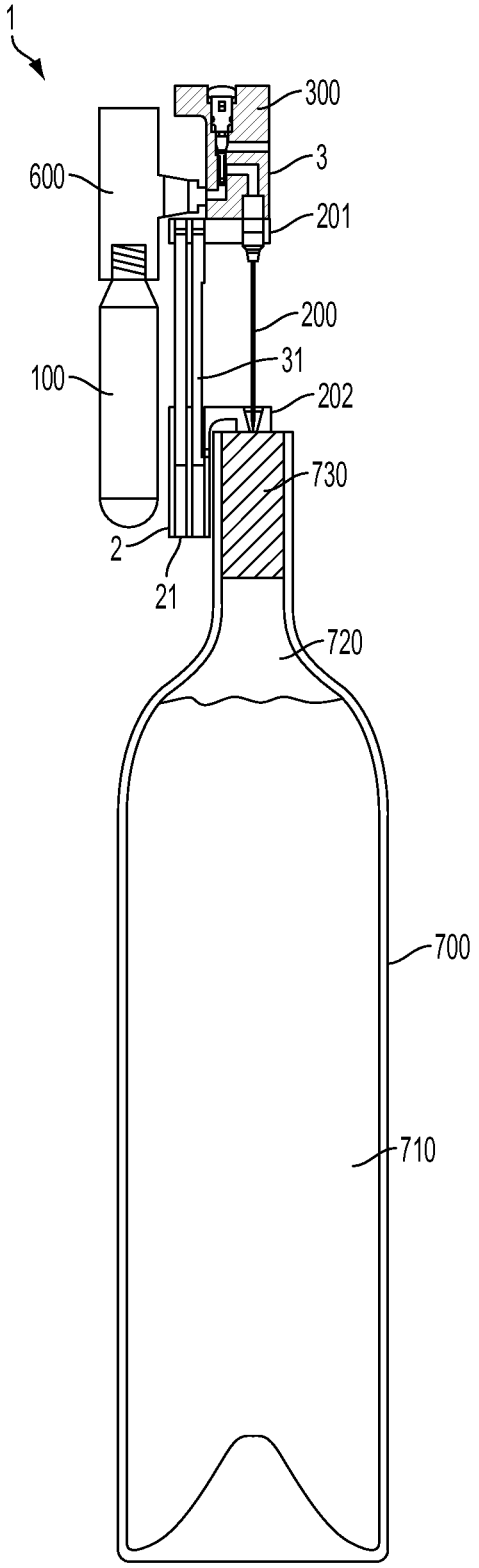
FIG. 1 shows a sectional side view of a beverage extraction device in preparation for introducing a needle through a closure of a beverage container.

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

FIGS. 1-4 show schematic views of one embodiment of a beverage extraction device 1 that may incorporate one or more aspects of the invention. This illustrative system 1 includes a body 3 with an attached pressurized source of gas 100 (such as a compressed gas cylinder) that provides gas under pressure (e.g., 2600 psi or less as dispensed from the cylinder) to a regulator 600. In this arrangement, the cylinder 100 is secured to the body 3 and regulator 600 by a threaded connection, although other configurations are possible, such as those described below and/or in U.S. Pat. No. 4,867,209; U.S. Pat. No. 5,020,395; and U.S. Pat. No. 5,163,909 which are hereby incorporated by reference with respect to their teachings regarding mechanisms for engaging a gas cylinder with a cylinder receiver. The regulator 600 is shown schematically and without detail, but can be any of a variety of commercially available or other single or multi-stage pressure regulators capable of regulating gas pressures to a pre-set or variable outlet pressure. The main function of the regulator 600 is to provide gas at a pressure and flow rate suitable for delivery to the container 700 (such as a wine bottle), e.g., so that a pressure established inside the container 700 does not exceed a desired level.

In this embodiment, the body 3 also includes a valve 300 operable to control the flow of gas from the regulator 600. The valve 300 may be a 3-way toggle valve that includes a single operation button and functions to selectively introduce pressurized gas into the container 700 and extract beverage 710 (such as wine) from the container 700 via a needle 200. Details regarding the operation of such a valve 300 are provided in U.S. Pat. No. 8,225,959, which is incorporated by reference in its entirety. Of course, other valve arrangements for controlling pressurized gas and beverage flow are possible. For example, the 3-way valve 300 could be replaced with a pair of on/off valves, one for controlling gas introduction to the container 700, and another for controlling flow of beverage from the container 700. Each valve could have its own actuator, allowing a user to selectively open and close the valves, whether individually or simultaneously. In short, details regarding the operation of the regulator 600 and valve 300 or other mechanisms for introducing gas into a container, and removing beverage from the container 700 are not necessarily limitations on aspects of the invention and may be modified as suitable.

To introduce gas into the container 700 and extract beverage, a needle 200 attached to the body 3 is inserted through a cork or other closure 730 that seals an opening of the container 700. This illustrative system 1 uses a pencil-tip non-coring needle 200 with a needle opening 220 along a sidewall of the needle near the needle tip. While the needle 200 may be inserted into the cork or other closure 730 in different ways, in this embodiment, the system 1 includes a base 2 with a pair of channels 21 that receive and guide movement of respective rails 31 of the body 3. Thus, movement of the body 3 and attached needle 200 relative to the container closure 730 may be guided by the base 2, e.g., the body 3 may slide relative to the base 2 to move the needle 200 into/out of the closure 730. In addition, movement of the needle 200 may be guided by a needle guide 202 that is attached to the base 2 and positioned over the closure 730. Other arrangements for guiding movement of the body 3 relative to the base 2 are possible, such as providing one or more rails on the base 2 which engage with a channel or other receiver of the body 3, providing an elongated slot, channel or groove on the body or base which engages with a corresponding feature (e.g., a tab) on the other of the body or base and allows for sliding movement, a linkage that connects the body and base together and allows for movement of the body to insert the needle into the closure, and others.

In some embodiments, the base 2 may be fixed or otherwise held in place relative to the container 700, e.g., by a clamp arm, sleeve, strap or other device that engages with the container 700. Clamp arrangements in accordance with aspects of the invention are described in more detail below and may be used to temporarily or releasably secure the device 1 to a wine bottle neck or other container 700. By restraining movement of the base 2 relative to the container 700, such an arrangement may help guide motion of a needle 200 relative to the container 700 when penetrating a closure 730, or when being withdrawn from the closure 730. Alternately, the container 700 may be manipulated by grasping and manipulating the device 1 since the clamp engaging the device 1 to the container 700 may securely hold the device 1 and container 700 together.

Figure 2:
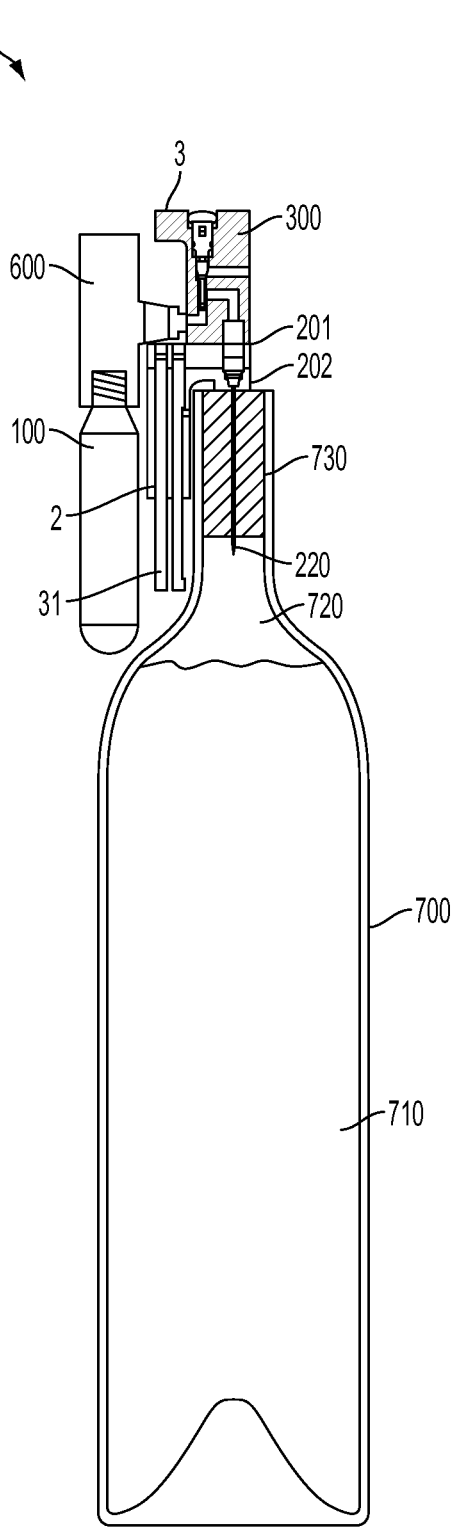
FIG. 2 shows the FIG. 1 embodiment with the needle passed through the closure.
Figure 3:
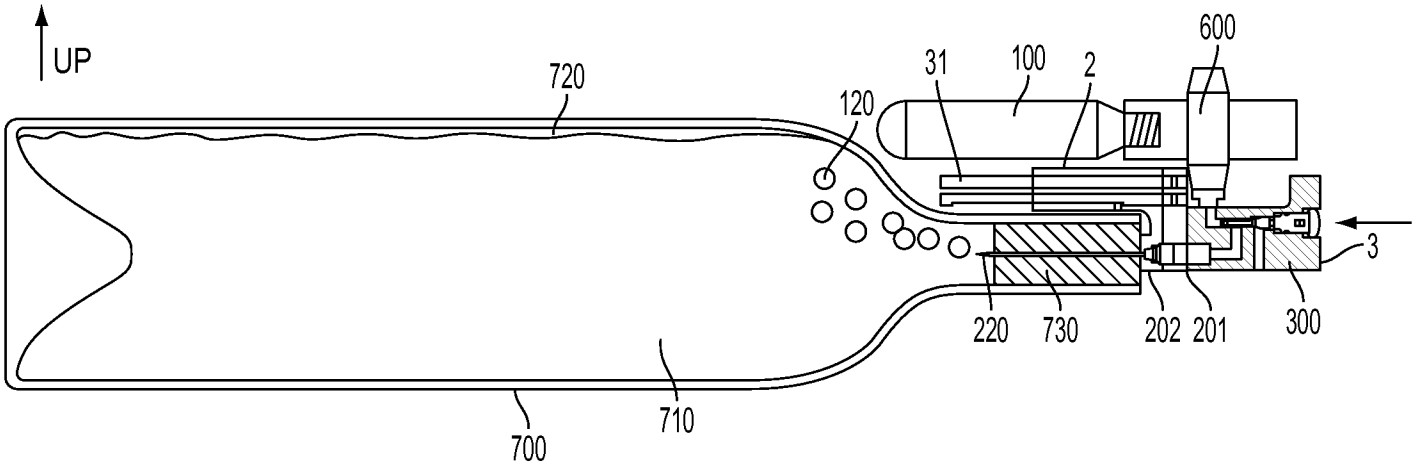
FIG. 3 shows the FIG. 1 embodiment while introducing gas into the container.
Figure 4:
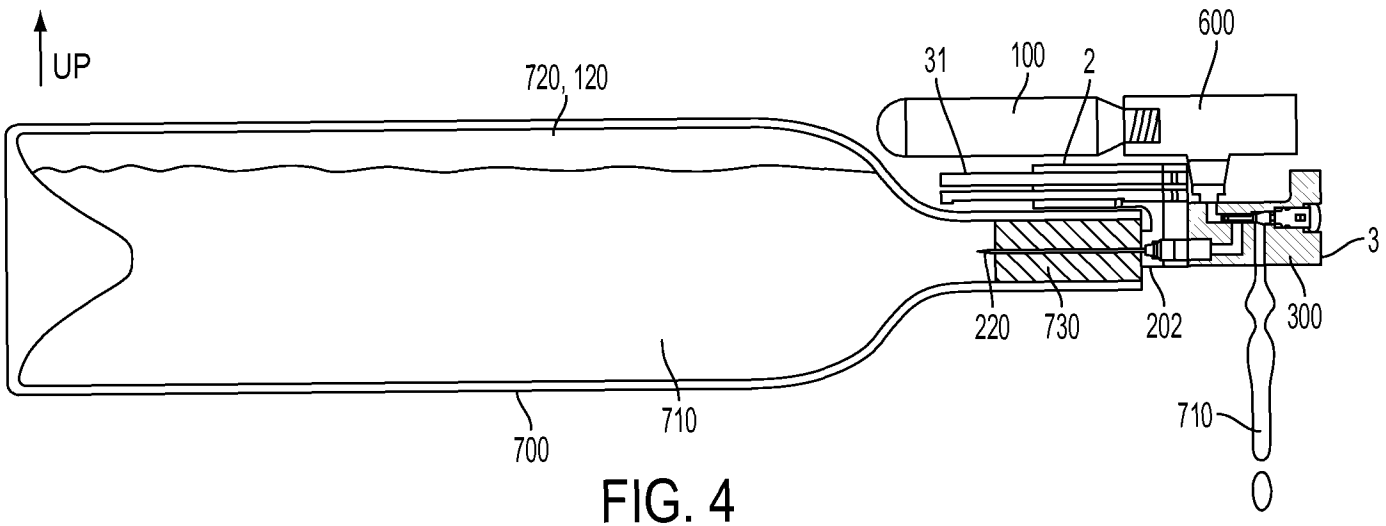
FIG. 4 shows the FIG. 1 embodiment while dispensing beverage from the container.

To insert the needle 200 through the closure 730, a user may push downwardly on the body 3 while maintaining the base 2 and the container 700 at least somewhat stationary relative to each other. The needle 200 will pass through the closure 730, guided in its motion, at least in part, by the guided motion of the body 3 relative to the base 2 (e.g., by the rails 31 and channels 21). With the needle 200 suitably inserted as shown in FIG. 2, a needle opening 220 at the needle tip may be positioned below the closure 730 and within the enclosed space of the container 700. The container 700 may then be tilted, e.g., so that the beverage 710 flows to near the closure 730 and any air or other gas 720 in the container 700 flows away from the closure. Pressurized gas 120 may then be introduced into the container 700 by actuating the valve 300 and causing gas from the cylinder 100 to flow through the valve 300 and needle 200 to exit at the needle opening 220, as shown in FIG. 3. Alternately, pressurized gas 120 can be introduced into the container 700 prior to tilting of the container, followed by tilting and dispensing of beverage. Thereafter, the valve 300 may be operated to stop the flow of pressurized gas and allow beverage 710 to flow into the needle opening 220 and through the needle 200 to be dispensed from the valve 300, as shown in FIG. 4.

As discussed above, a beverage extraction device may include a clamp configured to engage the device with a container, e.g., by clamping the device to the neck of a bottle. For example, the device can include one or more clamp arms that are movably mounted to the device and are arranged to engage with a container to support the device on the container during use. In accordance with an aspect of the invention, the beverage extraction device may include one or more clamp arms that are arranged to not only engage a container during use of the device, but also support the device in an upright orientation on a flat, horizontal surface (such as a table top) so that the needle depends from the body with the distal end below the proximal end. This configuration may make the device more easily handled by a user, e.g., by positioning a handle of the device at an uppermost location for easy grasping. In addition, or alternately, allowing the device to stand upright may allow maintenance of the device more convenient, such as by positioning the device to allow a user to readily observe and/or replace the needle. Moreover, this arrangement may help prevent the beverage dispensing outlet from contacting potentially contaminating surfaces, e.g., because the outlet may be held up and out of contact with surrounding surfaces and so that a user can grasp the device handle with reduced risk of touching the outlet. As another example, the upright orientation may allow for convenient and space-saving storage of the device, e.g., in a cabinet or other location. In short, upright orientation of the device has been found to be an attractive feature to users for a variety of different reasons.

Figure 5:
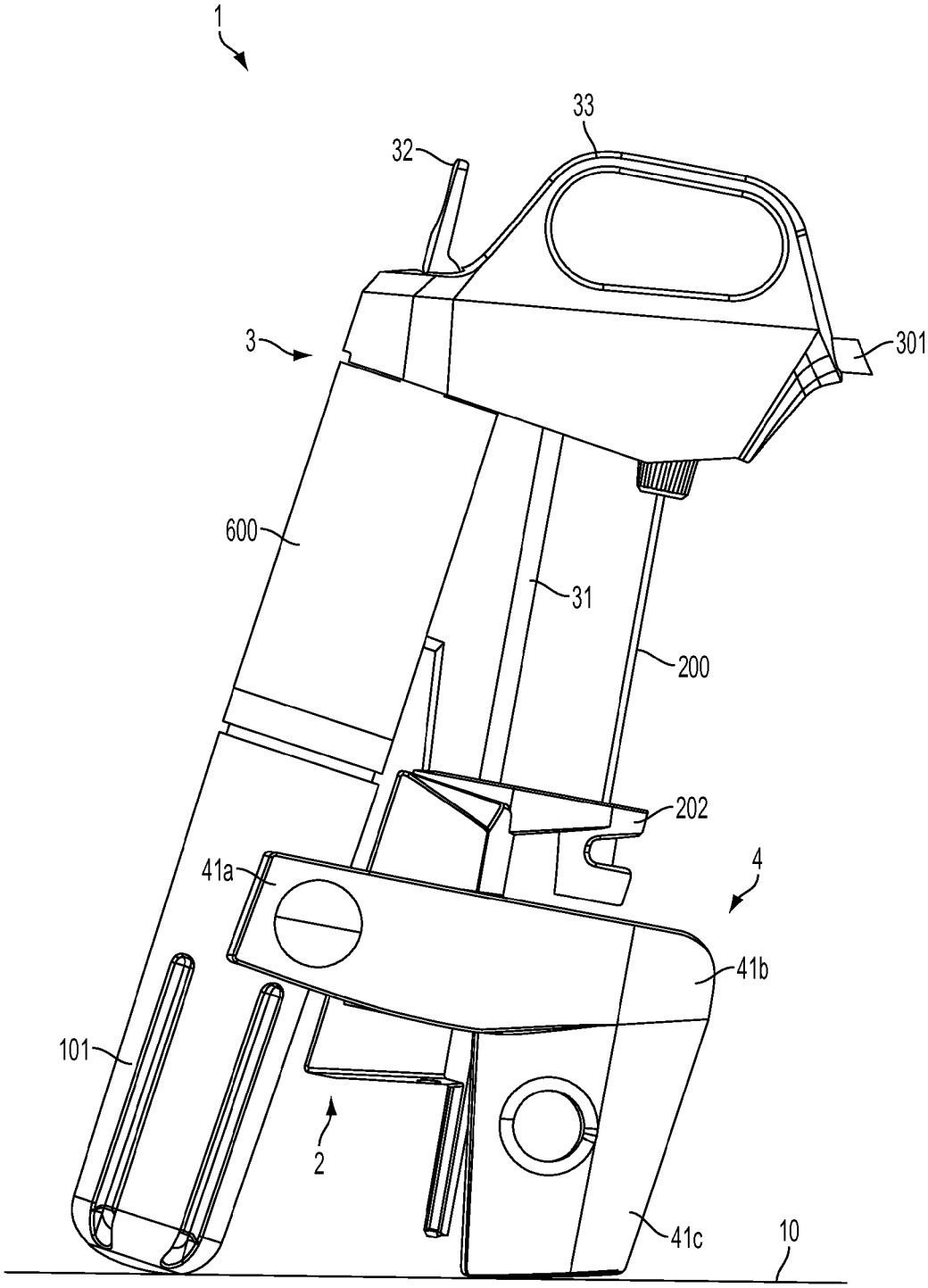
FIG. 5 shows a side view of a beverage extraction device having a clamp arrangement for supporting the device in an upright orientation in an illustrative embodiment.
Figure 6:
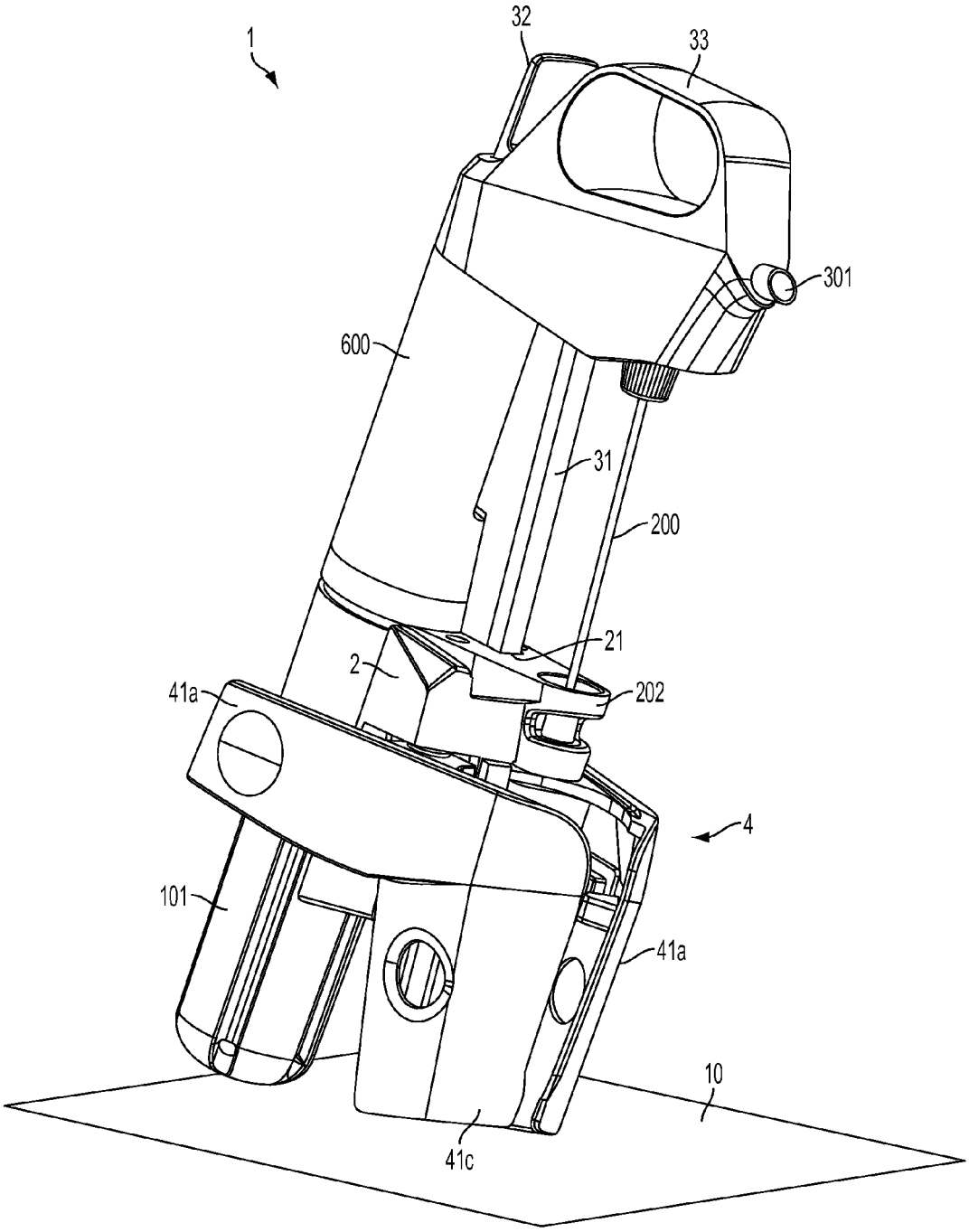
FIG. 6 shows a front perspective view of the FIG. 5 embodiment.

FIGS. 5 and 6 show a illustrative embodiment of a beverage extraction device 1 that incorporates aspects of the invention. This embodiment is similar in operation to that of FIGS. 1-4, but has a few different features. In this embodiment, the body 3 includes a handle 33, that may be gripped by a user for moving the body 3 relative to the base 2 in upward and downward motions to insert a needle 200 through a cork or other closure of a container 700. Also, a lever 32 is provided for operating the valve 300, e.g., to dispense beverage from an outlet 301 and/or deliver gas to the container 700 via the needle 200. To allow movement of the body 3 relative to the base 2, the body 3 includes a rail 31 that has T-shaped cross section, and is arranged to move within a T-shaped receiving slot or channel 21 of the base 2. As discussed above, however, other arrangements are possible for engaging the body 3 and base 2 while allowing for movement of the needle 200. Also, a gas cylinder cover 101 threadedly engages with the body 3 at the regulator 600 to engage and hold the cylinder 100 in place relative to the body 3. (A gas cylinder cover 101 in this embodiment is a kind of cap that covers the gas cylinder 100 and threadedly engages with another part of the body 3 to hold the gas cylinder 100 in place.) This arrangement of a gas cylinder cover 101 allows for the use of gas cylinders 100 that do not threadedly engage with the regulator 600, but rather are held in engagement with the regulator 600 by the cover 101.

Also included in this embodiment is a clamp 4 having a pair of clamp arms 41 that are arranged to support the device 1 in an upright orientation on a flat, horizontal surface 10, such as a table or counter top. (It should be appreciated, however, that a single clamp arm may be provided instead of a pair, as described in more detail below.) In this embodiment, the clamp arms 41 each include a downwardly extending portion 41*c* that contacts the surface 10 along with a lowermost portion of the body 3, which in this example is a lower end of gas cylinder cover 101. Thus, the clamp arms 41 and cover 101 may provide three points of contact with the surface 10, although additional (or fewer) points of contact may be provided. Note that in this embodiment, the lowermost portions of the downwardly extending portions 41*c* that contact the surface 10 are located proximally, relatively near the cover 101, and the lower surfaces of the downwardly extending portions 41*c* nearest the surface 10 form an angle with the surface 10 such that distal ends of the lower surfaces are uplifted from the surface 10. This arrangement may help prevent tipping of the device 1 forward. For example, if the device 1 is contacted while standing upright so that the device 1 begins to tip forward, the lower surfaces of the downwardly extending portions 41*c* may contact the surface 10 and help arrest movement of the device 1 and complete tipping over. Also, the cover 101 need not contact the surface 10 to help support the device 1, and instead other portions of the body 3 or the base 2 may contact the surface 10 to support the device 1 in an upright orientation. In another arrangement, the clamp arms 41 alone may contact the surface 10 and support the device 1. For example, a clamp arm 41 may include a "foot" or other structure that contacts the surface 10 to suitably support the device 1 without assistance from other parts of the device 1.

In this embodiment, the clamp arms 41 are arranged to support the device 1 in an upright orientation when the body 3 is in an uppermost position relative to the base 2, i.e., when the body 3 is moved upwardly as far as possible relative to the base 2. However, the clamp arms 41 may be arranged to support the device 1 in the upright orientation for other positions of the body 3 relative to the base 2, such as for upper positions of the body 3 relative to the base 2 (where the body 3 is positioned in an upper half of its range of movement relative to the base 2) or for any suitable position of the body 3 relative to the base 2. Thus, the clamp arms 41 may be arranged to help hold the device 1 in an upright position when the body 3 is in two or more positions relative to the base 2.

In this embodiment, the device 1 includes a detent that resiliently holds the body 3 in an upper position relative to the base 2, e.g., to help ensure that the body 3 does not move relative to the base 2 while at rest on a counter top. For example, the detent may include a spring-loaded ball or other element mounted on the base 2 that engages with a suitable groove on the body 3 to hold the body 3 and base 2 stationary relative to each other until suitable force is exerted to overcome the detent holding function. (See, for example, FIG. 9 which shows a detent 23 that includes a spring loaded plunger mounted to the base 2 that is arranged to engage with a groove or other feature on the rail 31 of the body 3.) Other detent arrangements are possible, such as a spring-loaded tab and slot, and others as will be appreciated by those of skill in the art. Moreover, a detent is not required to releasably hold the body 3 and base 2 in one or more positions relative to each other. For example, a friction element (such as a rubber strip positioned between the rail 31 and channel 21) may be included to provide a friction force that maintains the body and base stationary in the absence of a force over a threshold level. The friction element may provide the friction force for specific body/base positions, or throughout the full range of body/base movement. (As one example, the guides 24 shown in FIG. 9 that form part of the channel 21 may include portions that contact the rail 31 of the body 3 to provide suitable friction in movement of the rail 31 in the channel 21.) Other configurations are possible to help hold the body 3 and base 2 in one or more positions relative to each other, such as a spring-loaded pin, latch or other lock, a thumbscrew on the base 2 that can be tightened to engage the rail 31 and prevent body/base movement, etc.

Figure 7:
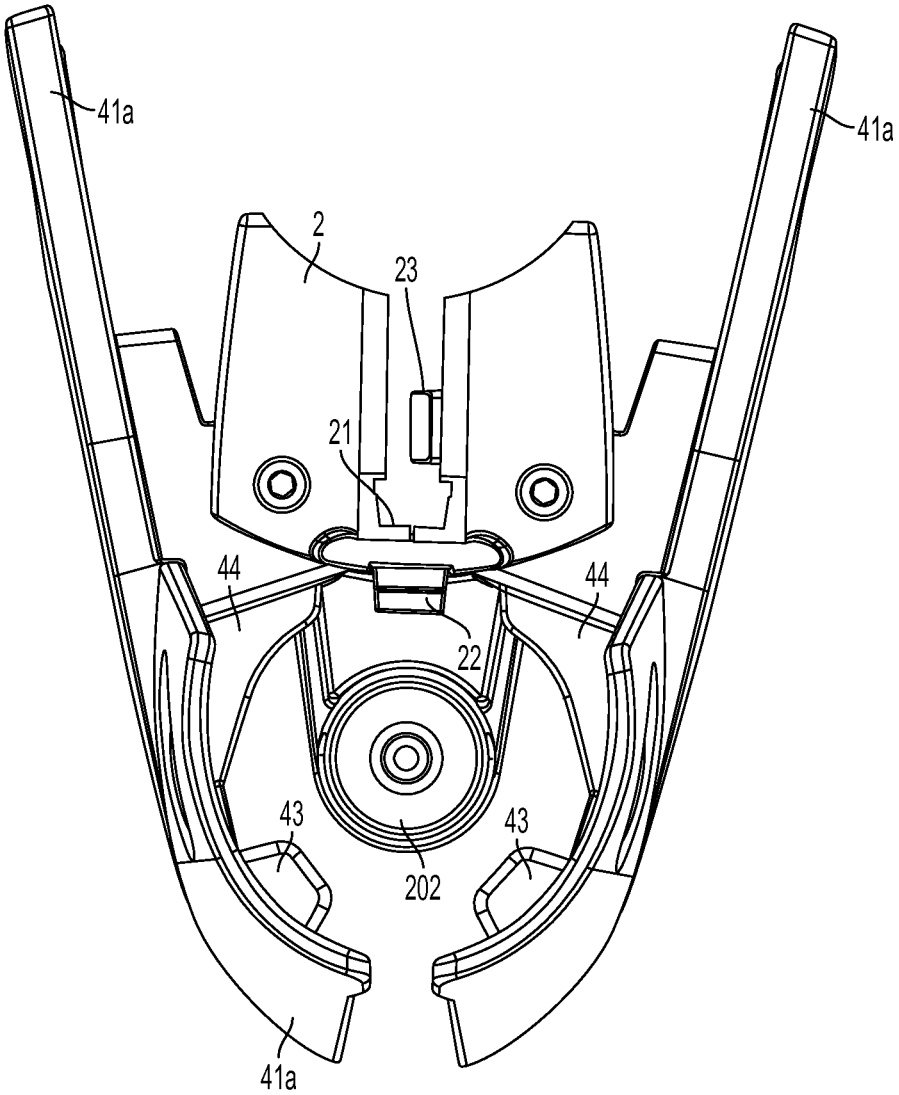
FIG. 7 shows a bottom view of the clamp arms of the FIG. 5 embodiment.
Figure 8:
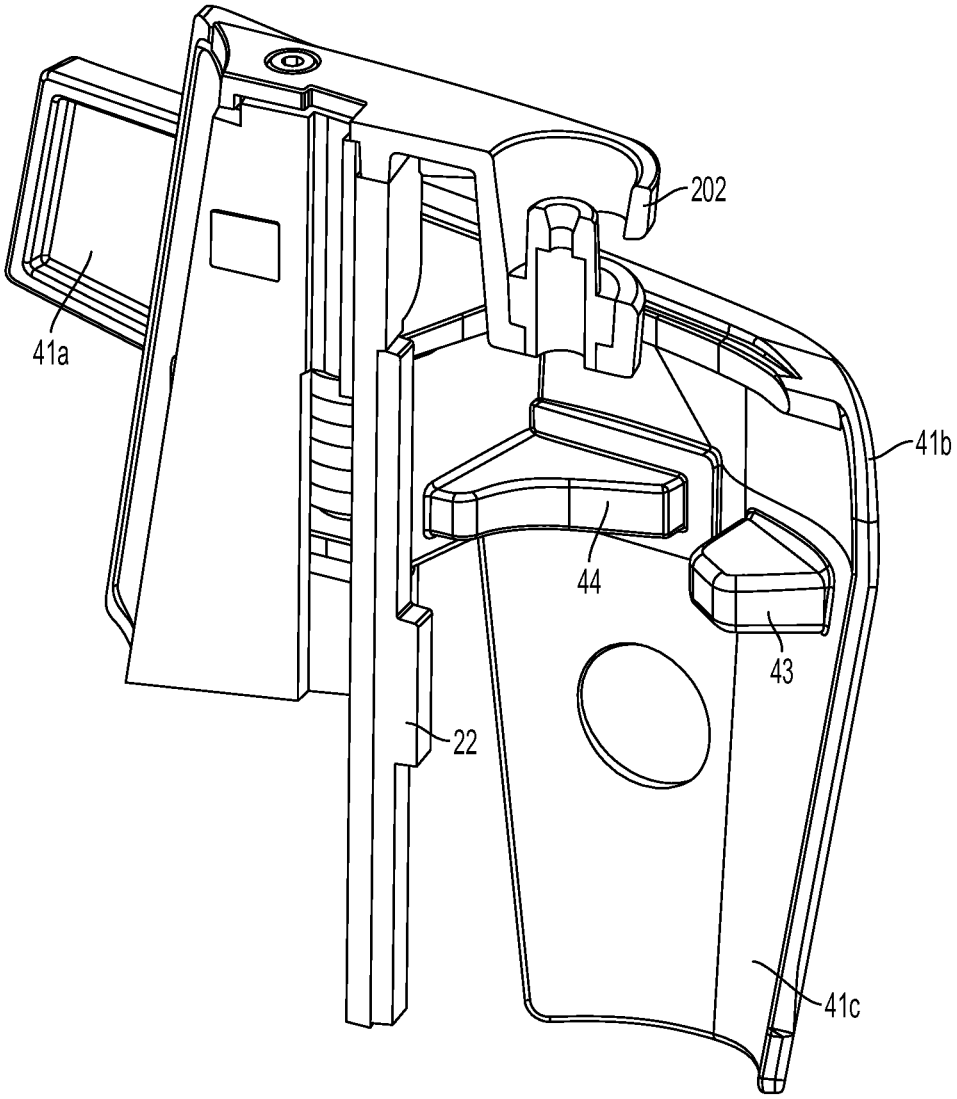
FIG. 8 shows a side view of an inner surface of a clamp arm of the FIG. 5 embodiment.
Figure 9:
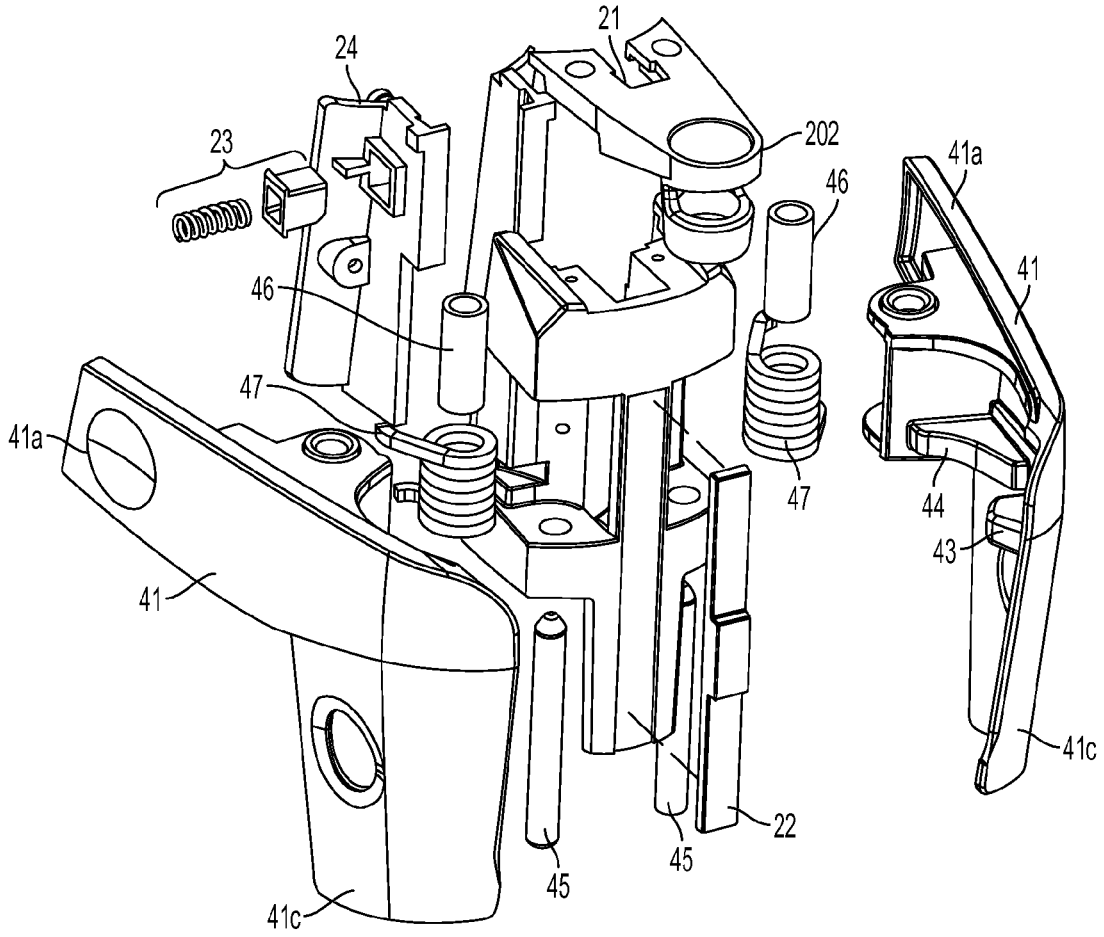
FIG. 9 shows an exploded view of the base in the FIG. 5 embodiment.

In accordance with another aspect of the invention, the clamp arm(s) may include a feature to help properly engage the clamp arm(s) with a variety of different bottle necks. For example, different bottles may have different neck diameters, different lip diameters or lengths (as used herein, a lip is a feature of many wine bottles near the top of the neck in which the bottle flares, steps or otherwise protrudes outwardly in size). In one embodiment, the clamp arm(s) include a distal tab feature and a proximal ridge feature that cooperate to properly engage with different neck configurations. FIGS. 7-9 show one illustrative embodiment in which each clamp arm 41 includes a distal tab 43 and a proximal ridge 44. The tab 43 may extend radially inwardly somewhat more than the ridge 44, and thus help to center the bottle neck or otherwise appropriately position the neck relative to the clamp arms 41. For example, as the clamp arms 41 are closed on a neck, the tabs 43 may contact the neck before the ridges 44, helping to center or otherwise appropriately position the neck relative to the device 1. In some embodiments, the tabs 43 and/or the ridges 44 may have portions that contact the container neck have a relatively hard, low-friction surface to help allow the clamp arms 41 engage the neck while allowing the neck to shift in position relative to the clamp arms 41.

In another aspect of the invention, the tabs 43 may help urge the neck proximally relative to the base 2, e.g., to move the neck toward a pad 22 located on the base 2 between the clamp arms 41. By urging the neck to move proximally and into contact with the pad 22 or other component, the clamp arms 41 may help position the neck in a consistent way relative to the needle guide 202 and the needle 200. This may help ensure that the needle 200 penetrates the closure 730 in a desired location. For example, the needle guide 202 and needle 200 may be arranged to pierce a closure 730 in a location that is offset from a center of the closure 730 with the neck positioned in contact with the pad 22. This may help avoid having the needle 200 penetrate the closure in the same location if the device 1 is used two or more times to extract beverage from the container 700. (As noted above, beverage can be extracted without removal of the closure 730, and since the closure can reseal after removal of the needle, beverage can be extracted multiple times from a container 700 without removal of the closure 730, although the closure 730 may be pierced several times to do so.) Alternately, the needle 200 and guide 202 may be configured to penetrate a closure at its center with the neck in contact with the pad 22, and by positioning the neck proximally and in contact with the pad 22, the closure 730 may be penetrated at the center as desired. In another arrangement in which the device is arranged to penetrate the closure 730 at a center position, the clamp arms 41 may each include semi-circular or other suitably arranged surfaces that contact the neck so the center of the closure 730 is always positioned for penetration by the needle 200.

The ridge 44 may have a length measured in a direction perpendicular to a bottle neck (or in a direction perpendicular to the length of the needle 200) that is greater than the tab 43, e.g., to help the ridge 43 provide a suitably long contact surface for the lip of the bottle. For example, while the tabs 43 may help center the neck between the clamp arms 41 and urge the neck to move proximally, the ridges 43 may contact an underside of the bottle lip with a suitably long surface to help prevent the neck from moving downwardly relative to the clamp arms 41 more than a desired distance. The extended length of the ridges 44 may provide the ridges 44 with greater strength and help the clamp arms operate with a wide array of bottle neck and lip sizes and shapes. In addition, the ridges 44 may have a variable radial length, e.g., increasing proximally as shown in FIG. 7, to help ensure that the ridges 44 will provide suitable engagement with a variety of different necks having different lip dimensions.

The pad 22 in this illustrative embodiment includes a strip of resilient material, such as a rubber, that can help the device grip the bottle neck when engaged by the clamp arms 41. In some embodiments, the pad 22 may include a protrusion or step near a lower portion of the pad 22 (see FIGS. 8 and 9) so that the pad 22 can engage with a lower surface of a lip on a bottle neck, e.g., similarly to the ridge 44. The pad 22 may extend in a direction along the length of the needle, i.e., along a length of the bottle neck, and may have any suitable length. Generally, however, the pad 22 will have a length that is equal to or shorter than a length of the shortest bottle necks to be engaged by the device 1. Similar is true of the clamp arms 41. That is, the clamp arms 41 may have distal portions 41*b* that extend downwardly, in a direction along the length of the needle 200, to an extent that allows the clamp arms 41 to receive and engage bottles that have a somewhat short neck. In one embodiment, the distal portions 41*b* of the clamp arms 41 may extend downwardly at least to an extent equal to or greater than a lowermost position of the distal end of the needle 200 when the body 3 is positioned at a lowermost position relative to the base 2. In this way, the needle 200 may be prevented from contacting a surface 10 when the device is standing upright on the surface 10. Also, the needle 200 may be movable relative to the clamp arms 41 to be positioned within a space between the clamp arms 41 throughout its full range of movement.

In this illustrative embodiment, the clamp arms 41 are pivotally mounted to the base 2 such that the distal portions 41*b* are normally biased to move toward each other, e.g., to clamp a bottle neck positioned between the arms 41. For example, as shown in FIG. 9, the clamp arms 41 are mounted to the base 2 via pivot pins 45 and bushings 46. However, the clamp arms 41 may be movably mounted relative to the base 2 in other ways, such as by a linkage, living hinge, a sliding engagement (such as by having a portion of a clamp arm move in a channel of the base), and others. Also, one arm may be fixed to the base while the other is made movable (although in this embodiment the arms are still said to be movable relative to each other). Torsion or other springs may be used to provide the biasing force (if provided at all) on the clamp arms 41. For example, in this embodiment, torsion springs 47 are mounted over the bushings 46 and are arranged to engage the base 2 and a clamp arm 41 so that the clamp arms are biased to move the distal portions 41*b* toward each other. This clamping force of the clamp arms 41 may be sufficiently robust to support the device 1 on the container 700, or even to allow a user to lift and pour beverage from the container 700 by grasping and manipulating the device 1. The clamp arms 41 may also include proximal portions 41*a* that can be grasped by a user and moved together (overcoming the biasing force of the springs 47) so that the distal portions 41*b* are moved away from each other to receive a bottle neck. For example, in this embodiment, a user may pinch the proximal portions 41*a* together to position a bottle neck between the distal portions 41*b*, and then release the proximal portions 41*a* to allow the clamp arms 41 to clamp the bottle neck. However, other arrangements are possible. For example, the distal portions 41*b* may instead be biased to move away from each other and move toward each other when a user applies suitable force, e.g., to the distal portions 41*b*, to overcome the biasing force. In another embodiment, the clamp arms 41 need not be spring biased at all. In such arrangements where the clamp arms 41 are biased to move the distal portions 41*b* apart or are not biased at all, a locking mechanism may be used to engage the clamp arms 41 to the container.

That is, whether the clamp arms 41 are spring biased or not, movement of the arms may be restricted or otherwise controlled in some way by a locking mechanism. For example, the arms 41 may be secured together by a ratchet and pawl mechanism that allows the distal portions 41*b* of the clamp arms 41 to move freely toward each other, but prevents movement of the distal portions 41*b* away from each other unless the pawl is first cleared from the ratchet. This arrangement may allow a user to securely clamp the arms 41 onto a bottle neck with the ratchet and pawl ensuring that the arms 41 will not move away from each other to release the neck until the user releases the pawl. In other embodiments, the arms 41 may be secured against movement away from each other in alternate ways, such as by a buckle and strap (with the strap secured to one arm 41 and the buckle secured to the other arm 41), a screw and nut (in which the screw engages one arm 41, the nut engages the other arm 41, and the screw and nut threadedly engage each other to secure the arms 41 together), a hook-and-loop closure element that spans across the arms 41 at their distal end, or other arrangement suited to engage the arms 41 with the container 700.

Figure 10:
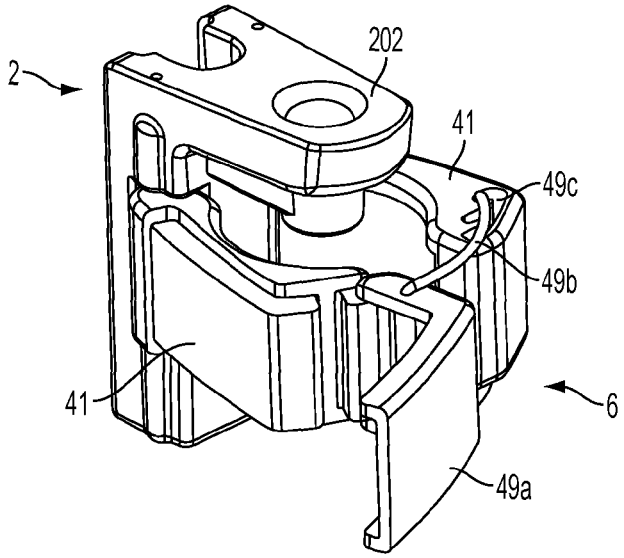
FIG. 10 shows a perspective view of a locking mechanism for a clamp in an illustrative embodiment in an open condition.
Figure 11:
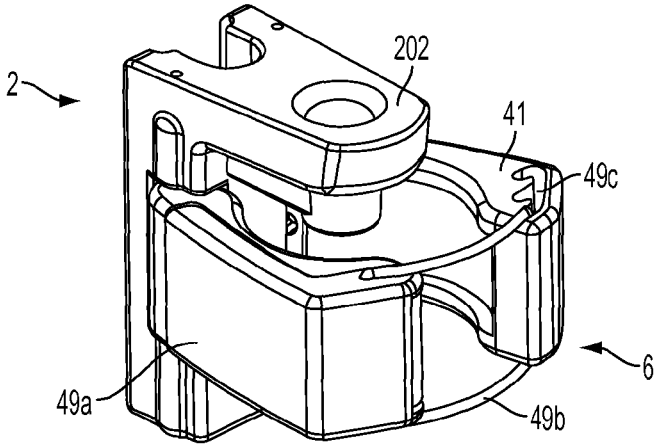
FIG. 11 shows the FIG. 10 embodiment with the clamp in a closed condition.

For example, FIGS. 10 and 11 show an illustrative embodiment in which the clamp arms 41 include a locking mechanism 6 in the form of a buckle similar to that found in some ski boots. In this embodiment, the locking mechanism 6 includes a handle 49*a* that is pivotally mounted to a clamp arm 41 and carries a bail 49*b*. The bail 49*b* is arranged to selectively engage with one of the bail-engaging slots 49*c* formed in the other clamp arm 41. Accordingly, the locking mechanism 6 in this embodiment is arranged to provide three different positions of the bail 49*b* on the bail-engaging slots 49*c*, thus allowing the locking mechanism to provide three different adjustment positions for engaging different sized container necks. To engage the clamp arms 41 to a neck, the bail 49*b* is engaged with a suitable slot 49*c*, and the handle 49*a* is rotated to lock the clamp arms 41 is place. Of course, other locking mechanisms are possible. Thus, the clamp 4 may include a locking mechanism that has a single locking position, multiple locking positions, a continuously variable locking position, a series of indexed or stepped locking positions, and/or a user defined locking position. Such clamp arm securing arrangements may be used whether the distal portions 41*b* of the clamp arms 41 are biased to move toward each other, away from each other, or with no bias at all.

Figure 12:
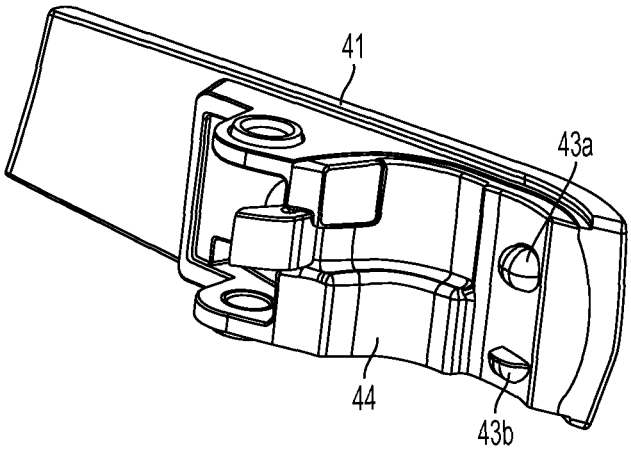
FIG. 12 shows a perspective view of a clamp arm in an alternate embodiment including a rocker element.
Figure 13:
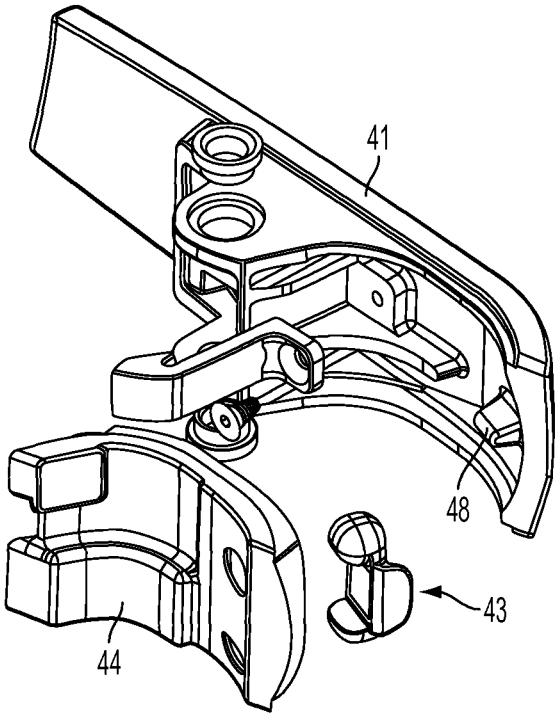
FIG. 13 shows an exploded view of the FIG. 12 embodiment.

FIGS. 12 and 13 show another illustrative embodiment of a clamp arm 41 having an alternate configuration for a tab 43 and ridge 44. In this embodiment, the tab 43 has a rocker component with an upper lip-contacting part 43*a* and a lower lip-engagement part 43*b*. The tab 43 in this embodiment operates such that as the clamp arm 41 is engaged with a bottle neck, the upper part 43*a* contacts a lip of the neck before the lower part 43*b* contacts the neck. This causes the rocker component to pivot about a rocker fulcrum 48 (see FIG. 13—the fulcrum 48 is formed on the arm 41), causing the lower part 43*b* to be moved inwardly toward the neck. This presses the lower part 43*b* against the narrower diameter section of the neck below the lip. In this embodiment, the ridge 44 is provided by an elastomeric part (e.g., made of molded rubber) that is attached to the inner surface of the clamp arm 41 and includes a pair of openings through which the upper and lower parts 43*a*, 43*b* protrude. This adaptive arrangement for the tab 43 may allow the clamp arm 41 to operate more effectively with a wide variety of different neck and lip diameters, lengths and shapes because the tab 43 can move to accommodate different conditions.

Figure 14:
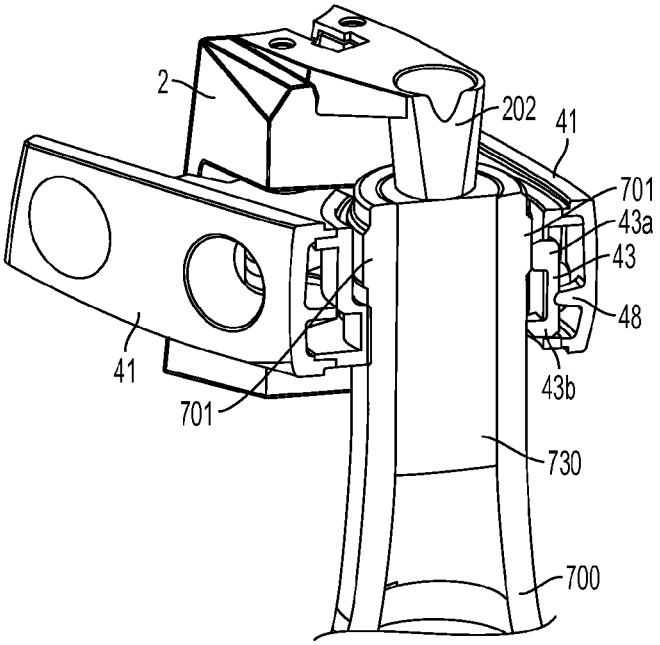
FIG. 14 shows a beverage extraction device having a clamp arm arranged as in FIG. 12 engaging the neck of a container.

FIG. 14 shows a device 1 having clamp arms 41 arranged like that shown in FIGS. 10 and 11 engaged with an illustrative neck of a container 700. The upper part 43*a* of the tab 43 is shown contacting the lip 701 of the container 701, causing the lower part 43*b* to pivot outwardly about the fulcrum 48 and contact the container 700 below the lip 701. The lower part 43*b* of the tab may include a notch or step feature with a substantially flat surface that faces a lower edge of the neck lip 701, potentially maximizing interlock between the lower part 43*b* and the lip 701. The tab 43, as well as the ridge 44 and other container-contacting parts may present a low friction or high friction surface to the container. High friction surfaces may help with neck engagement, e.g., to help prevent slipping of the neck relative to the clamp 4, whereas lower friction surfaces may allow the neck to more easily center or otherwise position itself relative to the device 1 during clamping and/or provide for more positive engagement between the clamp and the container. In this embodiment, the ridge 44 presents a relatively high friction surface (e.g., a molded rubber component) whereas the tab 43 presents a lower friction surface (e.g., a molded plastic of a higher durometer than the rubber part).

Figure 15:
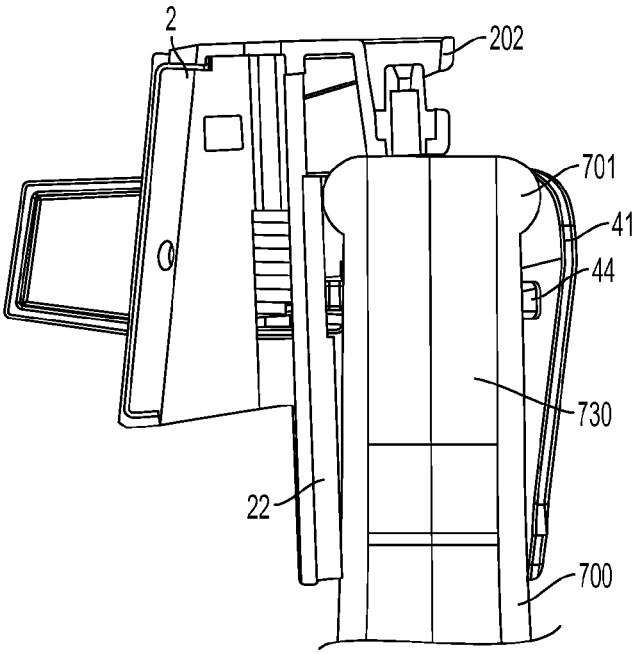
FIG. 15 shows a beverage extraction device having a clamp arm arranged as in FIGS. 7-9 engaging the neck of a container.

FIG. 15 shows a sectional view of a device arranged as in FIGS. 5-9 engaged with the neck of a container 700. As can be seen in this view, the neck has been urged proximally relative to the device 1 so that the neck contacts the pad 22 on the base 2. The needle guide 202 is positioned over the closure 730, and the lip 701 contacts the pad 22 along with another portion of the neck below the lip 701. As a result, the upper face of the closure 730 is presented at an angle to the needle guide, e.g., is not necessarily perpendicular to needle 200 as the needle penetrates the closure 730. The step in the surface of the pad 22 facing the neck can alleviate this somewhat, e.g., help to position the closure 730 so that its upper face is more perpendicular to the needle 200, although such positioning is not necessarily critical. Also shown is the ridge 44 of the clamp arm 44 positioned below the lip 701. As a result, if the container 700 is moved downwardly relative to the base 2, the ridge 44 may contact the lip 701 and prevent such downward movement beyond a certain point. In some embodiments, engagement of the clamp arms 41 and base 2 with the container 700 may allow a user to lift the container 700 by simply lifting the device 1, e.g., a user may pour beverage from the container 700 by gripping the device 1 only. The downwardly extending portions 41*c* of the clamp arms 41 in this embodiment extend along the neck and may assist in better engaging the container 700 with the device 1. For example, and as can be seen in FIG. 15, a lower end of the downwardly extending portions 41*c* may contact the container neck, helping to urge the container into contact with the pad 22 as well as provide another point of contact with the neck to help prevent movement of the neck relative to the clamp arms 41. This lower end of the clamp arms 41 may bear a high friction surface, such as a rubber element, to provide enhanced grip.

In accordance with an aspect of the invention, a device may be arranged such that the needle penetrates the closure of containers at a location positioned away from the center of the closure. For example, as can be seen in FIG. 15, the needle guide 202 is positioned relative to the closure 730 such that the needle 200 (not shown) will be guided into a portion of the closure 730 away from a center of the closure 720 (shown by a vertical dashed line in FIG. 15). As described above, penetrating the closure 730 away from the center of the closure 730 may help allow the closure to reseal after needle removal if the closure is penetrated more than once by a needle. As will be appreciated by those of skill in the art, ensuring that the closure 730 is penetrated at an off-center position can be achieved in a variety of ways. For example, in the embodiment of FIG. 15, the clamp arms 41 urge the bottle neck to move proximally into contact with the pad 22. Thus, every time this particular bottle neck is engaged by the device 1, the neck will be positioned in contact with the pad 22. If the needle guide 202 and needle 200 are positioned relative to the pad 22 such that the needle 200 is off-center relative to the closure 720, the needle 200 will always pierce the closure at an off-center position. Also, if the horizontal distance between the needle/needle guide and the pad is less than the radial distance from the center of the closure to the outer edge of the bottle lip for the smallest size bottle necks to be used with the device 1, the device will reliably penetrate the closure of all bottles at an off-center position.

Figure 16:
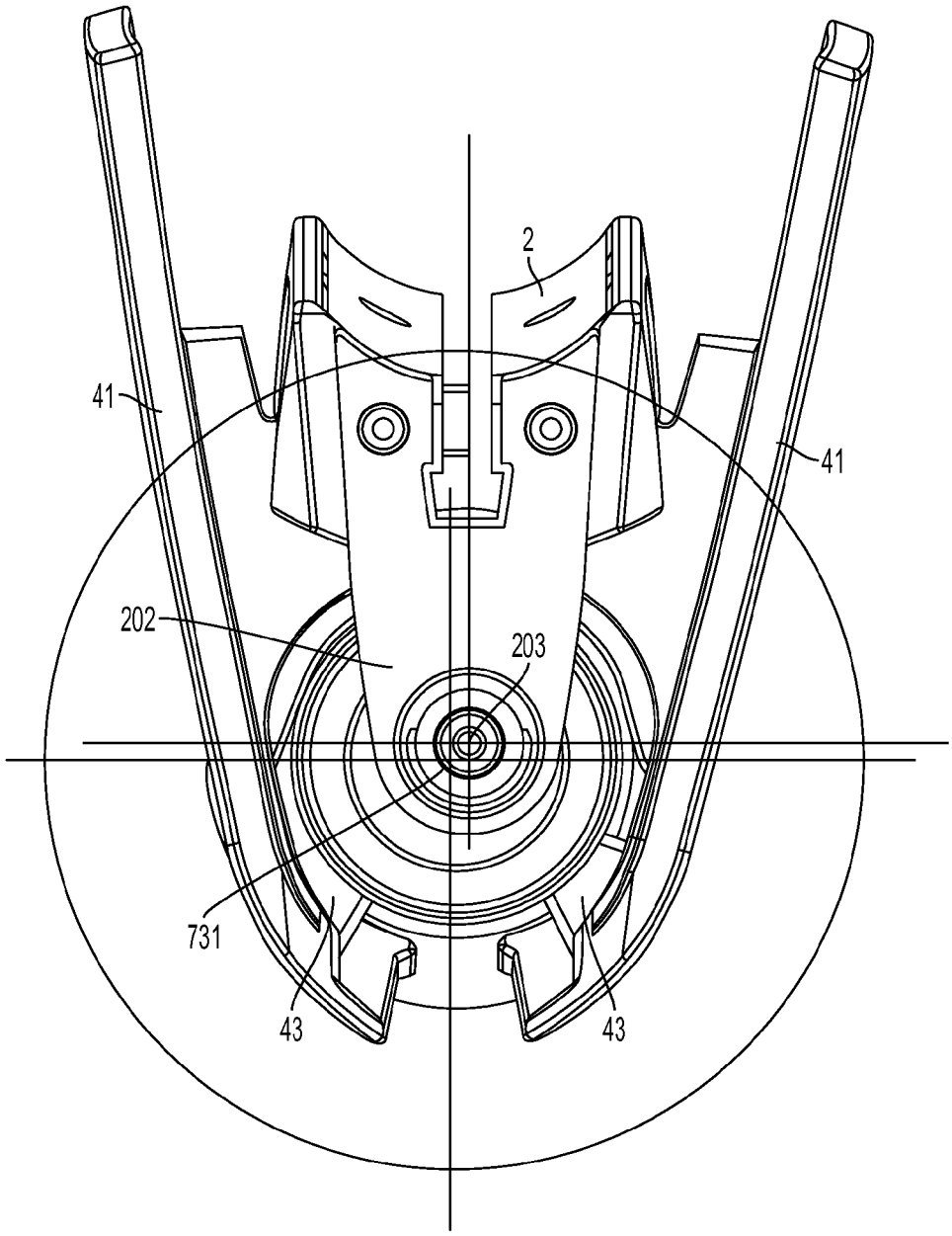
FIG. 16 shows an illustrative embodiment in which the clamp arms are arranged to position a center of a container closure off-center with respect to a needle penetration point.

Off-center penetration of a closure can be achieved in other ways than simply offsetting the needle and needle guide with respect to the pad a certain distance. For example, the clamp arms 41 may be arranged to engage a bottle neck so that the center of the closure is always offset from the needle penetrating area regardless of neck diameter. In doing so, the clamp arms 41 need not necessarily place the bottle neck in contact with a pad 22 or similar reference surface, but rather may engage the neck without contact of any other part of the device with the neck. In another embodiment shown in FIG. 16, one or both of the pivot pins 45 for the clamp arms 41 may be offset relative to the base 2 so that the clamp arms 41 engage the bottle neck and shift the center of the closure 730 relative to the needle guide 202. In this embodiment, one or both of the pivot pins 45 of the clamp arms 41 are shifted so that the neck is positioned with the center of the closure 731 located to the left (as seen in FIG. 16) of the penetration point 203 of the needle 200 as guided by the needle guide 202. Thus, according to this embodiment, regardless of the diameter of the bottle neck, the center of the closure 731 will always be positioned to the left of the needle penetration point 203. This feature, along with an appropriate offset of the needle guide 202 relative to the clamp arms 41 and/or the pad 22, may ensure not only that the closure center 731 is located to the left (or right) of the penetration point 203, but also that the closure center 731 is located forward (or rearward) of the penetration point 203. Such closure center 731 positioning can be achieved in other ways as well, such as by having the torsion springs 47 arranged with different spring constants, arranging the tabs 43 (if present) to have different radial lengths, providing a user adjustment feature (such as a thumbscrew that shifts the position of the clamp arms on the base 2), and others.

Figure 17:
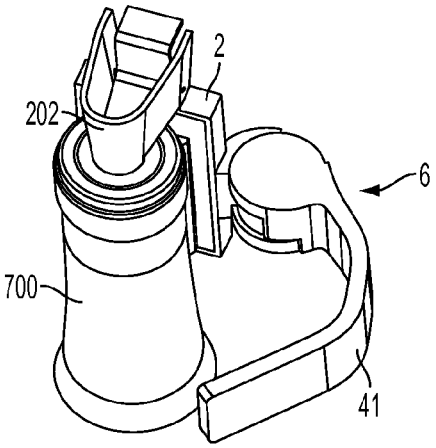
FIG. 17 shows an illustrative embodiment of a clamp arrangement having a single clamp arm.
Figure 18:
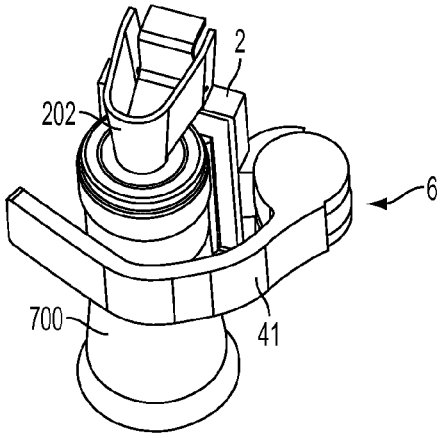
FIG. 18 shows the FIG. 17 embodiment with the clamp arm in the closed position.
Figure 19:
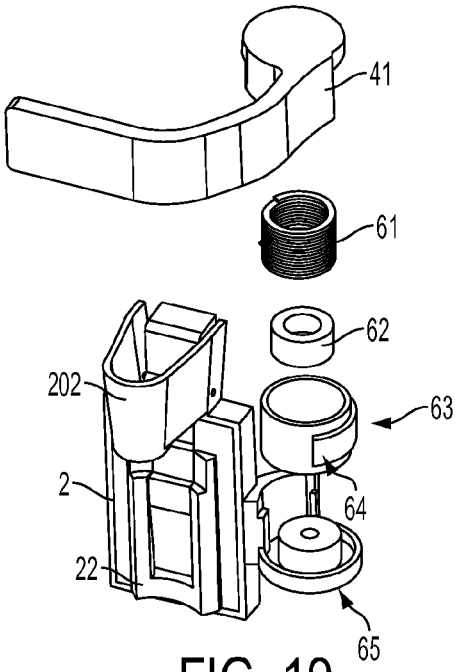
FIG. 19 shows an exploded view of a locking mechanism used with the FIG. 17 embodiment.

FIGS. 17-19 show another embodiment of a container clamp arrangement that includes a single clamp arm and that optionally can be configured to engage a container neck so that the closure is penetrated at an off-center position. (It should be appreciated, however, that the FIGS. 17-19 clamp arrangement could be used in a device that penetrates the closure at a center position as well.) In this embodiment, the clamp arrangement includes a single clamp arm 41 that is pivotally mounted to the base 2. A locking mechanism 6 is arranged to permit a user to freely move the clamp arm 41 from an open position (shown in FIG. 17) toward a closed position (shown in FIG. 18), but resists movement of the arm 41 from a closed position toward an open position. As a result, the device 1 can be associated with a container neck as in FIG. 17, and the clamp arm 41 moved to engage the neck as in FIG. 18 so that the device 1 is supported on the container. With the clamp arm 41 engaging the neck in a closed or clamping position, the arm 41 cannot be moved toward an open position unless the locking mechanism 6 is released. Thus, the device 1 may be engaged with the container and remain engaged with the container until a user releases the clamp arm 41. The clamp arm 41 and/or the pad 22 (see FIG. 19) may be arranged so that the neck is engaged to position a center of the closure 730 away from a penetration point of the needle 200, and thus ensure off-center penetration. For example, the pad 22 may have a semi-circular surface that contacts a container neck so as to offset the center of the closure 730 from a penetration point of the needle 200.

While the locking mechanism 6 may be arranged in other ways, in this embodiment the locking mechanism 6 includes a clutch spring 61 that is fitted over, and is engageable with an upper binding post 62 that is fixed to the clamp arm 41 and a lower binding post 65 that is fixed to the base 2. As will be understood by those of skill in the art, the clutch spring 61 may engage the binding posts 62, 65 so as to allow movement of the clamp arm 41 in a clockwise direction (as viewed from above) relative to the lower binding post 65, yet resist counterclockwise movement. A sleeve 63 may house the clutch spring 61 and a release tab 64 may be movable by a user to release the clutch spring 61 from the upper binding post 62 so as to allow the clamp arm 41 to move in the counterclockwise direction. Another spring (not shown) may be used to bias the clamp arm 41 to move toward the open position, e.g., so that the arm 41 moves under the spring bias to the open position when the release tab 64 is activated. Other arrangements for the locking mechanism are possible, such as ratchet and pawl configurations, rotary detents, etc.

Note also that aspects of the invention may be used with clamping arrangements that include a single clamp arm, or more than one clamp arm. Thus, embodiments are not restricted to use of two clamp arms. For example, the FIGS. 17-19 embodiment may be modified to allow the clamp arm to support the device in an upright position, as discussed in connection with FIGS. 5-7.

It has been found that needles having a smooth walled exterior, pencil point or Huber point needle of 16 gauge or higher are effective to penetrate through a wine bottle cork or other closure, while sealing effectively with the cork to prevent the ingress or egress of gases or fluids during beverage extraction. Moreover, such needles allow the cork to reseal after withdrawal of the needle, allowing the container and any remaining beverage to be stored for months or years without abnormal alteration of the beverage flavor. Further, such needles may be used to penetrate a foil cover or other wrapping commonly found on wine bottles and other containers. Thus, the needle may penetrate the foil cover or other element as well as the closure, eliminating any need to remove the foil or other wrapping prior to beverage extraction. Other needle profiles and gauges are also usable with the system.

While in the above embodiments the needle guide 202 and needle are positioned to have the needle penetrate the center of the closure 730, the lower opening or through hole of the guide 202 could be arranged to introduce the needle at a location offset from the center of cork 730. This may decrease the chances that a needle penetrates the closure 730 in a same location if the system 1 is used to dispense beverage from the container several times and may allow the closure 730 to better reseal upon needle withdrawal.

While in the above embodiments, a user moves the body 3 in a linear fashion relative to the base 2 to insert/remove a needle with respect to a container closure, a manual or powered drive mechanism may be used to move a needle relative to a closure. For example, a rail 31 may include a toothed rack, while the base 2 may include a powered pinion gear that engages the rack and serves to move the body 3 relative to the base 2. The pinion may be powered by a user-operated handle, a motor, or other suitable arrangement. In another embodiment, the needle may be moved by a pneumatic or hydraulic piston/cylinder, e.g., which is powered by pressure from the gas cylinder 100 or other source.

A needle used in a beverage extraction device may be a smooth exterior walled, cylindrical needle with a non-coring tip that can be passed through a cork without removing material from the cork. One non-coring tip is a pencil-tip that dilates a passageway through the cork, although deflected-tip and stylet needles have also been found to work properly and could be used in alternative embodiments. The pencil-tip needle preferably has at least one lumen extending along its length from at least one inlet on the end opposite the pencil-tip and at least one outlet proximal to the pencil-tip. As shown above, a needle outlet may be positioned in the side-wall of the needle at the distal end of the needle, although proximal of the extreme needle tip.

With the correct needle gauge, it has been found that a passageway (if any) that remains following removal of the needle from a cork self-seals against egress or ingress of fluids and/or gases under normal storage conditions. Thus, a needle may be inserted through a closure to extract beverage, and then be removed, allowing the closure to reseal such that beverage and gas passage through the closure is prevented. While multiple needle gauges can work, preferred needle gauges range from 16 to 22 gauge, with an optimal needle gauge in some embodiments being between 17 and 20 gauge. These needles gauges may offer optimal fluid flow with minimal pressures inside the container while doing an acceptably low level of damage to the cork even after repeated insertions and extractions.

Multiple needle lengths can be adapted to work properly in various embodiments, but it has been found that a minimum needle length of about 1.5 inches is generally required to pass through standard wine bottle corks. Needles as long as 9 inches could be employed, but the optimal range of length for some embodiments has been found to be between 2 and 2.6 inches. (Needle length is the length of a needle that is operable to penetrate a closure and/or contact a needle guide for guidance in moving through the closure.) The needle may be fluidly connected to the valve directly through any standard fitting (e.g. NPT, RPT, Leur, quick-connect or standard thread) or alternatively may be connected to the valve through an intervening element such as a flexible or rigid tube. When two or more needles are used, the needle lengths may be the same or different and vary from 0.25 inches to 10 inches. Creating distance between the inlet/outlets of the needles can prevent the formation of bubbles.

In some embodiments, a suitable gas pressure is introduced into a container to extract beverage from the container. For example, with some wine bottles, it has been found that a maximum pressure of between around 40 and 50 psi may be introduced into the bottle without risking leakage at, or ejection of, the cork, although pressures of between around 15 and 30 psi have been found to work well. These pressures are well tolerated by even the weakest of cork-to-bottle seals at the bottle opening without causing cork dislodging or passage of liquid or gas by the cork, and provide for relatively fast beverage extraction. The lower pressure limit in the container during wine extraction for some embodiments has been found to be between about 0 and 20 psi. That is, a pressure between about 0 and 20 psi has been found needed in a bottle to provide a suitably fast extraction of beverage from the bottle. In one example using a single 17 to 20 gauge needle, a pressure of 30 psi was used to establish an initial pressure in a wine bottle, and rapid wine extraction was experienced even as the internal pressure dropped to about 15-20 psi.

The source of pressurized gas can be any of a variety of regulated or unregulated pressurized gas containers filled with any of a variety of non-reactive gases. In a preferred embodiment, the gas cylinder contains gas at an initial pressure of about 2000-3000 psi. This pressure has been found to allow the use of a single relatively small compressed gas cylinder (e.g., about 3 inches in length and 0.75 inches in diameter) for the complete extraction of the contents of several bottles of wine. Multiple gases have been tested successfully over extended storage periods, and preferably the gas used is non-reactive with the beverage within the container, such as wine, and can serve to protect the beverage oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas.

The embodiment above, a single needle with a single lumen is used to introduce gas into the container and extract beverage from the container. However, in other embodiments two or more needles may be used, e.g., one needle for gas delivery and one needle for beverage extraction. In such an embodiment, the valve 300 may operate to simultaneously open a flow of gas to the container and open a flow of beverage from the container. The needles may have the same or different diameters or the same or different length varying from 0.25 to 10 inches. For example, one needle delivering gas could be longer than another that extracts wine from the bottle. Alternately, a two lumen needle may be employed where gas travels in one lumen and beverage travels in the other. Each lumen could have a separate entrance and exit, and the exits could be spaced from each other within the bottle to prevent circulation of gas.

Multiples of these components could be combined into single parts or components serving multiple functions. For example, the needle guide may be made part of a container clamp.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A beverage extraction device, comprising:

a base for supporting components of the beverage extraction device;

at least one clamp arm mounted to the base and movable to clamp a beverage container neck and support the base on a beverage container;

a body movably mounted to the base, the body including a lowermost portion that is a portion of a compressed gas cylinder cover; and a needle having at least one lumen extending from a proximal end to a distal end, the proximal end of the needle being mounted to the body, the needle being arranged to be inserted through a closure at an opening of the beverage container with movement of the body relative to the base;

wherein the at least one clamp arm and the lowermost portion are arranged to cooperate to support the device in an upright orientation on a flat, horizontal surface such that the needle depends from the body with the distal end below the proximal end.

2. The device of claim 1, further comprising a gas source fluidly coupled to the needle and arranged to deliver pressurized gas to the at least one lumen at the proximal end of the needle.

3. The device of claim 2, wherein the gas source includes a compressed gas cylinder.

4. The device of claim 1, wherein the at least one clamp arm includes a pair of clamp arms movable relative to each other and wherein the body is slidably movable relative to the base to move the distal end of the needle in a space between the clamp arms.

5. The device of claim 4, further comprising a detent that resiliently locks the body in an upper position relative to the base.

6. The device of claim 1, wherein the body includes a rail, and the base includes a channel arranged to receive and guide movement of the rail relative to the base.

7. The device of claim 1, wherein the needle is arranged for insertion through a cork of a wine bottle and for delivery of a gas into the wine bottle.

8. The device of claim 1, wherein the needle is arranged for insertion through a cork of a wine bottle and for delivery of wine from the bottle.

9. The device of claim 1, wherein the at least one clamp arm includes a pair of clamp arms movable relative to each other, and wherein the clamp arms are each pivotally mounted to the base and are spring biased such that distal portions of the clamp arms are urged to move toward each other.

10. The device of claim 9, wherein the clamp arms have proximal ends that are movable toward each other by a user to move the distal portions of the clamp arms away from each other.

11. The device of claim 1, wherein the at least one clamp arm includes a pair of clamp arms movable relative to each other, and wherein the clamp arms have distal portions that each have an inner surface with a distal tab and a proximal ridge arranged to contact a neck of a beverage container positioned between the distal portions of the clamp arms.

12. The device of claim 11, wherein the distal portions of the clamp arms are spring biased to move toward each other such that the tab and ridge of each clamp arm contacts a beverage container neck and urges the neck to move proximally relative to the clamp arms.

13. The device of claim 1, wherein the at least one clamp arm includes a pair of clamp arms movable relative to each other, and wherein the base includes a resilient pad between the clamp arms and arranged to contact a beverage container neck clamped by the clamp arms.

14. A beverage extraction device, comprising:

a base for supporting components of the beverage extraction device;

a pair of clamp arms mounted to the base and having distal portions movable relative to each other to clamp a beverage container neck and support the base on a beverage container, each distal portion having an inner surface with a distal tab and a proximal ridge arranged to contact the neck of the beverage container positioned between the distal portions of the clamp arms;

a body movably mounted to the base; and a needle having at least one lumen extending from a proximal end to a distal end, the proximal end of the needle being mounted to the body, the needle being arranged to be inserted through a closure at an opening of the beverage container with movement of the body relative to the base.

15. The device of claim 14, wherein the distal portions of the clamp arms are spring biased to move toward each other such that the tab and ridge of each clamp arm contacts a beverage container neck and urges the neck to move proximally relative to the clamp arms.

16. The device of claim 14, wherein the base includes a resilient pad between the clamp arms and arranged to contact a beverage container neck clamped by the clamp arms.

17. The device of claim 14, wherein the clamp arms are each pivotally mounted to the base, and are spring biased such that distal portions of the clamp arms are urged to move toward each other.

18. The device of claim 14, wherein the clamp arms have proximal ends that are movable toward each other by a user to move the distal portions of the clamp arms away from each other.

19. The device of claim 14, further comprising a gas source fluidly coupled to the needle and arranged to deliver pressurized gas to the at least one lumen at the proximal end of the needle.

20. The device of claim 19, wherein the gas source includes a compressed gas cylinder.

21. The device of claim 14, wherein the body is slidably movable relative to the base to move the distal end of the needle in a space between the clamp arms.

22. The device of claim 21, further comprising a detent that resiliently locks the body in an upper position relative to the base.

23. The device of claim 14, wherein the body includes a rail, and the base includes a channel arranged to receive and guide movement of the rail relative to the base.

24. The device of claim 14, wherein the needle is arranged for insertion through a cork of a wine bottle and for delivery of a gas into the wine bottle.

25. The device of claim 14, wherein the needle is arranged for insertion through a cork of a wine bottle and for delivery of wine from the bottle.

26. The device of claim 14, wherein the clamp arms and a portion of the body are arranged to support the device in an upright orientation on a flat, horizontal surface such that the needle depends from the body with the distal end below the proximal end.

27. A beverage extraction device, comprising:

a base for supporting components of the beverage extraction device, the base including a pad;

at least one clamp arm movably mounted to the base and having a distal portion arranged to clamp a beverage container neck and support the base on a beverage container, the at least one clamp arm being arranged to urge the beverage container neck proximally and into contact with the pad when clamping the neck;

a body movably mounted to the base; and a needle having at least one lumen extending from a proximal end to a distal end, the proximal end of the needle being mounted to the body, the needle being arranged to be inserted through a closure at an opening of the beverage container with movement of the body relative to the base.

28. The device of claim 27, wherein the at least one clamp arm includes a pair of clamp arms movable relative to each other, and wherein the distal portion of each clamp arm has an inner surface with a distal tab and a proximal ridge arranged to contact the neck of a beverage container positioned between the distal portions of the clamp arms.

29. The device of claim 28, wherein the distal portions of the clamp arms are spring biased to move toward each other such that the tab and ridge of each clamp arm contacts a beverage container neck and urges the neck to move proximally relative to the clamp arms.

30. The device of claim 27, wherein the pad includes a resilient pad arranged to contact a beverage container neck clamped by the at least one clamp arm.

31. The device of claim 27, wherein the at least one clamp arm includes a pair of clamp arms movable relative to each other, and wherein the clamp arms are each pivotally mounted to the base and are spring biased such that distal portions of the clamp arms are urged to move toward each other.

32. The device of claim 31, wherein the clamp arms have proximal ends that are movable toward each other by a user to move the distal portions of the clamp arms away from each other.

33. The device of claim 27, further comprising a gas source fluidly coupled to the needle and arranged to deliver pressurized gas to the at least one lumen at the proximal end of the needle.

34. The device of claim 33, wherein the gas source includes a compressed gas cylinder.

35. The device of claim 27, wherein the at least one clamp arm includes a pair of clamp arms movable relative to each other, and wherein the body is slidably movable relative to the base to move the distal end of the needle in a space between the clamp arms.

36. The device of claim 35, further comprising a detent that resiliently locks the body in an upper position relative to the base.

37. The device of claim 27, wherein the body includes a rail, and the base includes a channel arranged to receive and guide movement of the rail relative to the base.

38. The device of claim 27, wherein the needle is arranged for insertion through a cork of a wine bottle and for delivery of a gas into the wine bottle.

39. The device of claim 27, wherein the needle is arranged for insertion through a cork of a wine bottle and for delivery of wine from the bottle.

40. The device of claim 27, wherein the at least one clamp arm and the base are arranged to engage a container neck such that the needle always pierces the closure at a location away from a center of the closure.

41. A beverage extraction device, comprising:

a base for supporting components of the beverage extraction device;

at least one clamp arm mounted to the base and movable to clamp a beverage container neck, the at least one clamp arm being spring biased to move and clamp the container neck with a spring force sufficient to suspend the device on a beverage container;

a body movably mounted to the base; and a needle having at least one lumen extending from a proximal end to a distal end, the proximal end of the needle being mounted to the body, the needle being arranged to be inserted through a closure at an opening of the beverage container with movement of the body relative to the base.

42. A beverage extraction device, comprising:

a base for supporting components of the beverage extraction device;

a pair of clamp arms pivotally mounted to the base and movable relative to each other to clamp a beverage container neck and support the base on a beverage container, wherein the clamp arms are spring biased such that distal portions of the clamp arms are urged to move toward each other;

a body movably mounted to the base; and a needle having at least one lumen extending from a proximal end to a distal end, the proximal end of the needle being mounted to the body, the needle being arranged to be inserted through a closure at an opening of the beverage container with movement of the body relative to the base;

wherein the pair of clamp arms are arranged to support the device in an upright orientation on a flat, horizontal surface such that the needle depends from the body with the distal end below the proximal end.

* * * * *